US009760031B2

(12) United States Patent
Liu et al.

(10) Patent No.: US 9,760,031 B2
(45) Date of Patent: Sep. 12, 2017

(54) METHOD FOR PREPARING SUSPENSION POLYMERIZATION TONER OF CORE-SHELL STRUCTURE

(71) Applicant: SHENZHEN LEPUTAI TECHNOLOGY CO., LTD, Shenzhen, Guangdong (CN)

(72) Inventors: Zhijun Liu, Shenzhen (CN); Yuanyuan Zhang, Shenzhen (CN); Tiantian Pu, Shenzhen (CN); Xiao Yuan, Shenzhen (CN); Hong Meng, Shenzhen (CN); Hui Yang, Shenzhen (CN)

(73) Assignee: SHENZHEN LEPUTAI TECHNOLOGY CO., LTD, Shenzhen (CN)

( * ) Notice: Subject to any disclaimer, the term of this patent is extended or adjusted under 35 U.S.C. 154(b) by 10 days.

(21) Appl. No.: 14/655,740

(22) PCT Filed: Apr. 2, 2013

(86) PCT No.: PCT/CN2013/073599

§ 371 (c)(1),
(2) Date: Sep. 18, 2015

(87) PCT Pub. No.: WO2014/101359

PCT Pub. Date: Jul. 3, 2014

(65) Prior Publication Data

US 2016/0018750 A1 Jan. 21, 2016

(30) Foreign Application Priority Data

Dec. 27, 2012 (CN) ..... 2012 1 0579391

(51) Int. Cl.
*G03G 9/093* (2006.01)
*G03G 9/08* (2006.01)

(52) U.S. Cl.
CPC ..... *G03G 9/0806* (2013.01); *G03G 9/09328* (2013.01); *G03G 9/09371* (2013.01); *G03G 9/09392* (2013.01)

(58) Field of Classification Search
CPC . G03G 9/09393; G03G 9/09321; G03G 9/093
See application file for complete search history.

(56) References Cited

U.S. PATENT DOCUMENTS 5,385,802 A * 1/1995 Inaba ..... G03G 9/08 430/108.22
2004/0229143 A1* 11/2004 Umemura ..... G03G 9/08782 430/108.4

(Continued)

FOREIGN PATENT DOCUMENTS

CN 101075100 A 11/2007
CN 101473274 A 7/2009

(Continued)

OTHER PUBLICATIONS

International Search Report of PCT Patent Application No. PCT/CN2013/073599 issued on Oct. 17, 2013.

(Continued)

*Primary Examiner* — Hoa V Le

(57) ABSTRACT

A method for preparing suspension polymerization toner of core-shell structure comprises following steps: 1) preparing a monomer oil phase containing a certain amount of polar resin forming toner soft core resin and aqueous dispersion liquid respectively; 2) adding the monomer oil phase into the aqueous dispersion liquid, transferring a mixture into a reactor after high-speed shearing and suspension granulation, and carrying out a first heating polymerization reaction to obtain toner particles of soft-core hard-shell structure; 3) taking the toner particles of soft-core hard-shell structure as a core layer, adding a cationic monomer component, and carrying out a second polymerization reaction through a (Continued)

water-soluble initiator to obtain the toner particles of soft-core hard-shell structure with dense charge surface layers uniformly distributed on outer surfaces; and 4) cleaning, filtering, and sufficiently drying a preceding product, and then adding silicon dioxide.

12 Claims, 2 Drawing Sheets

(56) References Cited

U.S. PATENT DOCUMENTS

| | | | | |
|---|---|---|---|---|
| 2007/0037083 | A1* | 2/2007 | Yamate | C07F 7/07<br>430/108.3 |
| 2009/0202931 | A1* | 8/2009 | Lincoln | G03G 9/0804<br>430/108.2 |
| 2009/0292078 | A1* | 11/2009 | Yoshinaka | A61K 8/8152<br>525/329.9 |

FOREIGN PATENT DOCUMENTS

| | | | |
|---|---|---|---|
| CN | 102207696 | A | 10/2011 |
| JP | S59170851 | A | 9/1984 |

OTHER PUBLICATIONS

1st Office Action of counterpart Chinese Patent Application No. 201210579391.8 issued on Nov. 22, 2013.

* cited by examiner

METHOD FOR PREPARING SUSPENSION POLYMERIZATION TONER OF CORE-SHELL STRUCTURE

TECHNICAL FIELD

The present patent application is related to toner manufacturing, and more particularly, to a method for preparing a chemical toner by a suspension polymerization process to develop an electrostatic charge image.

BACKGROUND

Toner is a developer material for a laser printer or a copy. The principle of operation of a printer substantially summarized as follows: a constant current flow through a charging roller to charge the surface of photosensitive drum uniformly. The surface of photosensitive drum which is charged uniformly is exposed with a laser beam and discharged to form an electrostatic latent image. The toner on the surface of the developing roller is charged by the friction of the blade. Under the action of the potential difference, the toner is absorbed on the surface of photosensitive drum to translate the electrostatic latent image to an image. Attracted by the opposite charges of a transfer roller, the image on the surface of photosensitive drum can be transferred on a paper. The image formed by the toner is hot melted and pressurized by a heating roller and a pressure roller. It is fixed on the surface of the paper. Thereby, we will get a printed image.

It can be seen from the running process of the printer that the surface uniformity and stable charging performance of the toner particles play a crucial role and influence in getting the image with a desired printing effect. Of course, the toner should have some other essential properties such as excellent transfer printing property, low-temperature fixation and environmental stability. The toner with a good sphericity has a high transfer printing efficiency, which can be easily transferred and printed from the photosensitive drum to the paper, while reducing or preventing toner remained on the surface of photosensitive drum.

Traditional mechanical pulverizing toner can be obtained by melting and blending resin, CCA, pigment and wax, pulverizing and classifying. The toner particles are irregular in shape. After the friction of the blade, these particles are non-uniformly charged due to the varied surface pressure. Furthermore, the pulverizing process causes some of CCA particles can easily fall off, which also results in the non-uniform charges and wide charges distribution of toner particles. In addition, the pulverizing toner cannot meet the requirements of low-temperature fixation and environmental storage stability due to the limitations of the process.

The suspension polymerization toner can be obtained by dispersing CCA, waxes, pigments and other components together into a monomer uniformly, and carrying out a polymerization after high-speed shearing and granulation. The CCA in the toner particles disperse more uniformly, and the particles have a better sphericity. Thereby, these particles have a good uniformity of charge distribution and transfer printing efficiency. But, most of the added charge control agent distribute in the central area of the toner particles. Since the toner is charged by the friction between the blade and the CCA on the surface of the toner, and the CCA distributing in the central area of the toner particles does not involve in the friction, there is a need to develop an effective method to improve the charge density on the surface of the toner.

Chinese Patent CN101473274 provides a toner of core-shell structure with a rigid and thin shell layer which is distributed with dense CCA formed by coating the surface of the toner core particles which is prepared by a suspension polymerization method with the charge control agent, via a polymer which is formed through a polymerization reaction of the shell monomer components. However, the method results a large amount of free CCA due to a poor compatibility of CCA and shell rein.

Chinese Patent CN101727031 provides a polymerization toner with high dense surface charges obtained by adding a reactive anionic surfactant containing a reactive functional group into an aqueous dispersant, grafting it to the surface of the toner particles by the way of polymerization. If the amount of the reactive anionic surfactants added in the method is too high, it results in fine particles in the suspension system. It also results in background pollution on the printed image. Furthermore, the high hydrophilic of the surfactant has effect upon the processes such as post-cleaning and post-process and the like.

Chinese Patent CN1707366 also provides a toner of core-shell structure including a surface layer with dense positive charges formed by polymerizing a monomer containing amine or ammonium salt on the surface of the toner core particles or salting out, melting and bonding with a polymer particle containing amine or ammonium salt. The toner core particles prepared with this method is substantially unchanged. The charging performance of the toner particles is mainly achieved by the surface layer of the particles. However, due to the efficiency of coating the surface layer of the particles, the system is easy to produce the particles with a poor charging performance even uncharged particles. Then it results in a poor printing quality.

On the other aspect, many patent applications with regard to the suspension polymerization toner provide a method of coating shell layer to improve the balance of low- temperature fixation and environmental stability of the toner particles. But coating shell layer inevitably results in that some of the CCA on the surface of the toner core particles is covered. It causes the surface of the toner particles is non-uniformly charged, which instead reduces the characteristic of surface electrification uniformity of the suspension toner.

SUMMARY

The present patent application aims to overcome deficiencies of the prior art described above, and to provide a method for preparing suspension polymerization toner of core-shell structure. The toner particles can have a uniform and stable charging property, at the same time a good low-temperature fixation and environmental stability.

The present patent application provides a preparation method of suspension polymerization toner of core-shell structure. The method includes the following steps of:

(1) preparing a monomer oil phase which contains a certain amount of polar resin forming toner soft core resin and aqueous dispersion liquid to disperse the monomer oil phase respectively.

(2) adding the monomer oil phase into the aqueous dispersion liquid, transferring the mixture into a reactor after high-speed shearing and suspension granulation, carrying out a first heating polymerization reaction, and obtaining toner particles of soft-core hard-shell structure.

(3) taking the toner particles of soft-core hard-shell structure as a core layer, adding a cationic monomer component, and carrying out a second polymerization reaction through a water-soluble initiator to obtain the toner particles of soft-core hard-shell structure with dense charge surface layers uniformly distributed on outer surfaces.

(4) Cleaning, filtering, and sufficiently drying a product of the second polymerization reaction, then adding silicon dioxide to obtain the suspension polymerization toner of core-shell structure having an average particles diameter of 5-10 μm.

The present patent application provides a method for preparing the suspension polymerization toner of core-shell structure utilizing the strong and stable positive characteristics that a cationic monomer shows by the ionization in the presence of suitable water. The method includes the following steps: preparing a monomer oil phase containing a certain amount of polar resin and aqueous dispersion liquid respectively; carrying out high-speed shearing and dispersing to prepare oil droplet particles having a uniform particle diameter; obtaining the toner particles of soft-core hard-shell structure after completing the reaction; adding a cationic monomer component, and carrying out a reaction to obtain a shell layer with dense charge uniformly distributed. Thereby, it can improve the surface charge uniformity of the toner particles. And it enables the toner particles to have a good low- temperature fixation and environmental stability. The suspension polymerization toner having a good low-temperature fixation and environmental stability can be obtained with the preparation method which is provided by the patent application. And it improves the charging performance of the toner. When being used in a laser imaging device, it has a high transfer printing efficiency, image density. There is no pollution on the surface of the photosensitive drum. It is excellent in imaging property, low-temperature fixation and transfer printing property. It can meet the requirements of low-temperature fixation during high-speed printing. Therefore, it has a wide prospect of application.

DETAILED DESCRIPTION

The following description is presented to enable a person of ordinary skill in the art to make and use the various embodiments. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the present technology. Thus, the disclosed technology is not intended to be limited to the examples described herein and shown, but is to be accorded the scope consistent with the claims.

Figure 1:
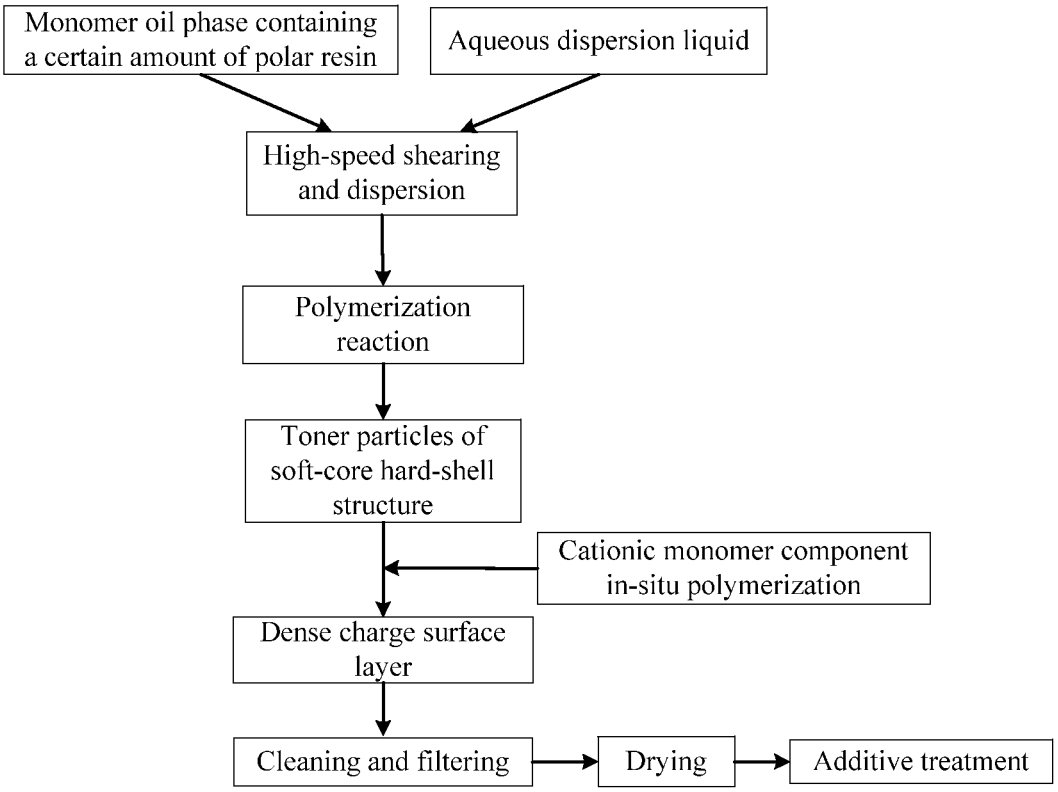
FIG. 1 is a flow chart of the process, according to the present patent application.
Figure 2:
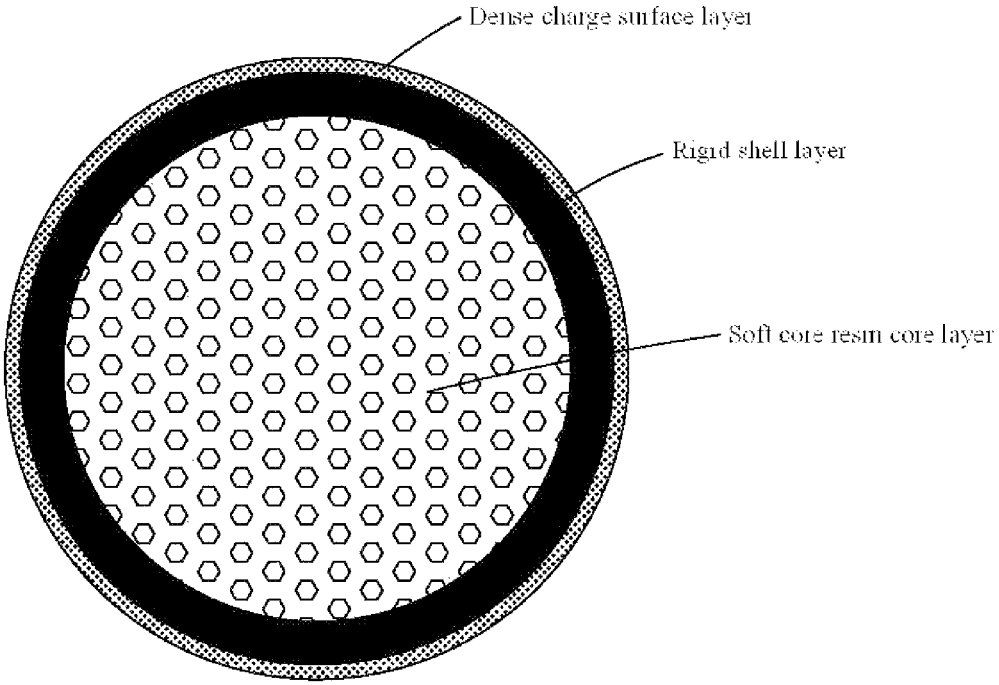
FIG. 2 is a schematic diagram of structure of the prepared suspension polymerization toner particles of core-shell structure with positive charges.

Referring to FIGS. 1 and 2, the present patent application provides a preparation method of the suspension polymerization toner of core-shell structure. The method includes the following steps of:

(1) preparing a monomer oil phase which contains a certain amount of polar resin forming toner soft core resin and aqueous dispersion liquid to disperse the monomer oil phase respectively.

(2) adding the monomer oil phase into the aqueous dispersion liquid, transferring the mixture into a reactor after high-speed shearing and suspension granulation, and carrying out a first heating polymerization reaction to obtain toner particles of soft-core hard-shell structure.

(3) taking the toner particles of soft-core hard-shell structure as a core layer, adding a cationic monomer component, and carrying out a second polymerization reaction through a water-soluble initiator to obtain the toner particles of soft-core hard-shell structure with dense charge surface layers uniformly distributed on outer surfaces.

(4) cleaning, filtering, and sufficiently drying a product of the second polymerization reaction, then adding silicon dioxide, and obtaining the suspension polymerization toner of core-shell structure having an average particle diameter of 5-10 μm.

In the preparation method described above, the monomer oil phase forming toner soft core resin is added a certain amount of polar resin. After mixing the monomer oil phase with the aqueous dispersion liquid, and carrying out high-speed shearing and polymerization, the toner particles of soft-core hard-shell structure having a good developing performance and environmental stability can be obtained. Utilizing the strong and stable positive characteristics of a cationic monomer which shows by the ionization in the presence of suitable water, and adding a cationic monomer component to carry out a second polymerization reaction, a shell layer with dense charges uniformly distributed can be obtained. Thereby, it improves surface electrification uniformity of the toner particles and enables the toner particles have a good low-temperature fixation property and environmental stability.

Details of the step described above will be described as follows.

1. Preparation Process of a Monomer Oil Phase (Components Forming Toner Soft Core Particles)

The components of the toner soft core particles of the present patent application include a binder resin, a charge control agent, a colorant, a release agent and a certain amount of polar resin. Wherein the binder resin is primarily a homopolymer or a copolymer of a monovinyl monomer. The molecular weight and distribution of the binder resin may be well adjusted by reasonable control and adjustment of the amount of a crosslinker and a chain transfer agent.

The preparation process of the monomer oil phase is formed by mixing a monovinyl monomer forming the soft core resin layer, a crosslinker, a chain transfer agent, a charge control agent, a colorant, a release agent, polar resin and an initiator.

Specifically, the monovinyl monomer can be primarily selected from one or more material of the following: styrene, methyl styrene or vinyl toluene and the like of monomers of aromatic vinyl; ethylene, propylene and the like of monoolefine monomer; methyl acrylate, ethyl acrylate, butyl acrylate, cyclohexyl acrylate, methyl methacrylate, ethyl methacrylate, hydroxyethyl methacrylate, glycidyl methacrylate and the like series monomer of acrylic acid and derivatives thereof. In the case of the particles of core-shell structure, the glass-transition temperature (Tg) of the polymer forming the core layer is preferably 30-80° C., more preferably 40-60° C. If the Tg is too high, it causes the lowest temperature of fixation becomes high. It is difficult to meet the requirements of low-temperature fixation.

Specifically, the crosslinker can be a monomer which contains two or more unsaturated vinyl groups. Using the crosslinker with the monovinyl monomer together can effectively improve the anti-high temperature offset property of the toner. The crosslinker of the present patent application can be selected from one or more material of the following: divinylbenzene, 2-methyl-1,3-butadiene, 1,3-butadiene, divinyl ether, divinyl sulfone, ethylene glycol dimethacrylate, triethylene glycol diacrylate, triethylene glycol dimethacrylate, 1,4-butanedioldimethacrylate, 1,6-hexanedioldimethacrylate, trimethylolpropane triacrylate, trimethylolpropane trimethacrylate or pentaerythritol triacrylate and the like. The amount of the crosslinker accounts for 0.1-10 wt % of the monovinyl monomer.

The chain transfer agent can effectively regulate the molecular weight of the resin. Using the chain transfer agent and the monovinyl monomer together can improve the firmness of fixation of the toner. The chain transfer agent of the present patent application can be selected from one or more material of the following: 1-dodecanethiol, t-dodecyl mercaptan, carbon tetrachloride, carbon tetrabromide and the like. The amount of the chain transfer agent accounts for 0.01-10 wt % of the monovinyl monomer, preferably 0.1-5 wt %. If the amount is too high, it results in a decrease of anti-high temperature offset property and storability. If the amount is too low, there is no obvious improvement of the fixation.

The positive charge control agent is used to provide an ideal electrified amount of the toner core particles. A variety of well-known positive charge control agents can be used. The positive charge control agent of the present patent application can be selected from one or more material of the followings: CCA1 (Central Synthetic Chemical Corporation), CCA2 (Central Synthesis Chemical Corporation), CCA3 (Central Synthetic Chemical Corporation) CCA501 (Central Synthetic Chemical Corporation), TP-415 (Hodogaya Chemical Industries Corporation), TP-302 (Hodogaya Chemical Industries Corporation), FCA-201-PS (Proton warehouse Kasei Corporation), FCA-207-P (Teng warehouse Kasei Corporation) and the like. Resin-type charge control agent can be uniformly dispersed and dissolved in the monomer oil phase. The positive resin-type charge control agent is preferable in the preparation of the suspension toner of the present patent application. The amount of the charge control agent generally accounts for 0.1-5 wt % of the monovinyl monomer, preferably 0.5-4 wt %.

The release agent of the present patent application can be selected from one or more wax of the following: polyethylene wax (PE wax), polypropylene wax (PP wax) and other polyolefin waxes; bran-wax, carnauba wax, candelilla wax, montan wax and other natural waxes; pentaerythrityl tetrastearate, pentaerythritol tetrabehenate, dipentaerythritol hexadipalmitate, dipentaerythritol hexamyristate or dipentaerythritol hexalaurate and other grease synthetic waxes. The polyethylene wax and polypropylene wax having a low molecular weight and the grease synthetic waxes having a hydroxyl value of less than 10 mgKOH/g, an acid value of less than 2 mgKOH/g are preferable. The waxes have a melting range of 50-100° C., preferably 60-80° C. The amount of the wax generally accounts for 1-30 wt % of the monovinyl monomer, preferably 2-15 wt %.

The colorant of the present patent application can be selected from at least one material of black pigment, yellow pigment, cyan pigment and magenta pigment. There is no limit for the black pigment. The black pigment can be primarily selected from carbon black, aniline black, colored pigments and mixtures. It can primarily selected from the color black having the primary particle diameter of 20-40 nm, such as MA-100 (Mitsubishi Chemical Corporation) #44 (Mitsubishi Chemical Corporation), #52 (Mitsubishi Chemical Corporation), MA7 (Mitsubishi Chemical Corporation), REGAL 300R (Cabot Corporation), REGAL 330R (Cabot Corporation), REGAL 400R (Cabot Corporation), MOGUL L (Cabot Corporation). The cyan pigment can be primarily selected from copper phthalocyanine compounds and derivatives thereof, such as C.I. Pigment Blue 15, 15:1, 15:2, 15:3, 15:4 and the like. The magenta pigment can be primarily selected from azo pigments such as C.I. Pigment Red 31, 48, 58, 63, 68, 112, 114, 122, 146, 150, 163, 187 and 206 and the like. The yellow pigment can be primarily selected from azo pigments, such as C.I. Pigment Yellow 3, 12, 17, 65, 74, 83, 97, 155, 181 and 186 and the like. The amount of the pigment is generally 1-30 wt % of the monovinyl monomer, preferably 1-15 wt %.

The polar resin of the present patent application can be obtained by carrying out polycondensation, addition polymerization or homopolymerisation, copolymerization and the like reaction of resin long chain with a polar bond structure including ester bond, amido bond, ether bond, urethane bond or imine bond and the like. Wherein the polycondensates include polyester, polyamide and the like. The additional polymers include polyether, polyether imide and the like. The copolymer is a copolymer of styrene or ethylene with an acrylate monomer. As the polar resin is added into the monomer composition to carry out a polymerization reaction, the polar resin tends to migrate to the surface layer of droplets of aqueous dispersion medium. Therefore, as the polymerization reaction proceeds, the polar resin is easy to be uniformly distributed on the surface portion of the particles. The toner particles can have a uniform surface state and uniform surface.

In the present patent application, in order to improve the compatibility of the polar resin and the core resin, the resin which has the same compositions as the core resin is preferable, such as: homopolymers of a cyano monomer, a halogen-containing monomer, an unsaturated carboxylic acid monomer, a nitro monomer and the like; or polymers of any of the above monomer and a styrene monomer or an unsaturated carboxylic acid ester monomer, epoxy resin or polyester. The polymerization toner having a good developing performance and environmental stability can be obtained by appropriate selection and use of saturated or unsaturated polar resins.

In order to improve the storage stability of the toner without affecting the low-temperature fixation, the Tg of the polar resin forming the shell layer is generally 60-130° C., preferably 80-120° C. The difference between the Tg of the resin forming the core layer and the Tg of the resin forming the shell layer should be greater than 20° C., preferably more than 30° C. If the difference is less than the value, the balance between environmental stability and fixation will be reduced. The weight-average molecular weight of the polar resin ranges in 6000-250000. The amount of the polar resin accounts for 5-30 wt % of the monovinyl monomer.

The initiator used in the monomer oil phase of the present patent application is an oil-soluble initiator. Because an oil-soluble initiator can be well dissolved in the soft core resin monomer, so that it can be distributed into each oil droplet particles. There is almost no difference in the resin molecular weight and distribution among the soft toner core particles which is obtained from a polymerization reaction. The oil-soluble initiator used in a suspension polymerization can be selected one or more material of the following:

2,2'-azobisisoheptonitrile, 2,2'-azoisobutyronitrile, 2,2'-azobis-(2-methylbutyronitrile), dimethyl 2,2'-azobis(2-methylpropionate) and other azo initiators; benzoyl peroxide (BPO), dilauroyl peroxide (LPO), tert-Butyl peroxy-2-ethylhexanoate, tert-Butyl peroxy diethyl acetate or tert-butylperoxyisobutyrate and other peroxide initiators. The amount of the initiator generally accounts for 0.5-20 wt % of the monovinyl monomer, preferably 1-10 wt %.

In the present patent application, a grinding and dispersing equipment can be used to complete the preparation of the monomer oil phase. Thereby, a good dispersion of carbon black and the uniformly mixing of various components can be achieved. The grinding equipment may be selected from any suitable type of horizontal or basket mill.

2. Preparation of Aqueous Dispersion Liquid:

A suspension dispersant can be employed in the preparation of aqueous dispersion liquid, the suspension dispersant can be selected from one or more material of the following: barium sulfate, calcium sulphate, calcium phosphate, magnesium hydroxide, aluminum hydroxide, magnesium carbonate, calcium carbonate, aluminium oxide, titanium dioxide, polyvinyl alcohol, gelatin or methyl cellulose. The dispersion stabilizer which contains a water-insoluble inorganic magnesium hydroxide colloid is preferable. Using the dispersant, the polymer particles having a narrow distribution of particles diameter can be obtained. There is a small residual resistance after adding acid and carrying out cleaning. The amount of the suspension dispersant accounts for 0.1-20 wt % of the monovinyl monomer.

Specifically, the preparation process of magnesium hydroxide colloid is as follows: disposing magnesium chloride solution and sodium hydroxide solution with deionized water; slowly adding the magnesium chloride solution (concentration of 5%-20%) into sodium hydroxide solution (concentration of 0.5%-10%); carrying out high-speed shearing with Ultratalax T50 (manufactured by IKA Corporation.) for 0.1-2 hours; ultrasonic dispersion aging for 2-6 hours to remove small number of large gommures which still remains in the prepared magnesium hydroxide colloid during high-speed shearing. Ultrasonic aging not only pulverizes the large gommures remained in the system, but also effectively prevent the formation of hydrogen bonds. And it avoids agglomeration among the nano-magnesium hydroxide. The particle diameter D90 (cumulative value of the number of particle diameter distribution of 90%) of the prepared magnesium hydroxide in the examples of the present patent application is less than 1.0 μm.

3. Process of Suspension Granulation

The process includes the following steps: suspension dispersing the toner core particles prepared in the monomer oil phase preparation process into aqueous dispersion liquid (stirring and blending according to the oil and water ratio of 1:2-1:8) to form oil droplet particles containing the colorant, the release agent, the charge control agent, the chain transfer agent, the polar resin; and carrying out shearing and granulation to the mixture of oil and water with a high-speed emulsifier or high-speed emulsion pump. The particle diameter of the oil droplet is in the range of 1-20 μm, preferably 5-15 μm. The temperature of suspension granulation is preferably 20-60° C.

In the preparation process, if the amount of the dispersion liquid is too small, and the dispersion system is instable, the oil droplet particles are prone to gather, which results in narrow distribution of particle diameter. If the amount of the dispersion liquid is too high, a large number of excessive fine latex particles can be produced during high-speed shearing, which is likely to result in background pollution during printing. The concentration of the aqueous dispersion liquid is preferably 0.5-5 wt %. The amount of the aqueous dispersion liquid accounts for 1%-20 wt % of the monomer oil phase.

In the preparation process described above, the dispersion apparatus for forming the oil droplet particles can be selected from at least one vigorous stirring device including: a batch Ultratalax T50 high-speed emulsifying disperser (IKA Corporation), Clearmix CLM-0.8S (M-Technique Corporation), DE-100L (Nangtong Clare mixing Equipment Corporation); continuous DRS 2000 (IKA Corporation), high-speed three emulsion pump (Shanghai, Yi Ken equipment Corporation). In order to further control the production of the oil droplet particles having a small particle diameter, a continuous high-speed or three DRS 2000 emulsion pump is preferably used to carry out a shearing process for the oil water dispersion system to obtain the suspension liquid droplet. The speed of suspension shearing and granulation is in range of 6000-25000 rpm. The linear velocity of high-speed shearing is in range of 15-40 m/s. It can meet the requirement of distribution of particle diameter of the toner particles by controlling the speed of shearing.

4. Process of Polymerization and Cladding

The process includes the following steps: transferring the oil droplet dispersion liquid into a polymerization reactor after suspension granulation; keeping the stirring speed at 100-1000 rpm (preferably 100-300 rpm) to suspend and disperse the dispersion droplet; heating to a predetermined temperature after adding nitrogen and removing oxygen; carrying out a first polymerization for some period; and obtaining the aqueous dispersion liquid of the toner core particles. Specifically, the temperature of polymerization is preferably 60-95° C. The time of polymerization is 2-20 hours, preferably 4-15 hours.

Additionally, the toner core particles are taken as the core layer. A dense charge surface layer which is prepared by the in-situ polymerization is uniformly distributed on the outer surfaces of the toner core particles. In the specific process, the cationic monomer implementing the surface layer with uniform charges can be selected from any known cationic monomer containing at least one unsaturated double bond including: monovinyl or bifunctional and etc, such as dimethyl diallyl ammonium chloride, acryloyloxyethyl trimethyl ammonium chloride, diethylaminoethyl acrylate, N,N-dimethyl-4-vinylaniline. The amount of the cationic monomer generally accounts for 0.1-2 wt % of the monovinyl monomer. In order to improve the compatibility and cladding ratio of the charged layer and the toner particles, the comonomer of the polymer with the formation of Tg greater than 70° C. is preferably added with the cationic monomer simultaneously, such as styene, methyl methacrylate and etc. The amount of the high-Tg monomer accounts for 0.1-10 wt % of the monovinyl monomer.

The process further includes the following steps: mixing the high-Tg shell layer monomer with the cationic in advance; carrying out a second polymerization reaction under the action of a water-soluble initiator to prepare and obtain the suspension polymerization toner of core-shell structure with dense charge surface layers uniformly distributed on outer surfaces having a high Tg. The free radical of the water-soluble initiator is easily moved around the surface of the toner soft core particles which is absorbed by a rigid shell layer monomer. As such, the toner particles of core-shell structure can be easily obtained. The average thickness of the charged surface layer is generally 1.0 μm or less, preferably ranges in 0.01-0.5 μm. The water-soluble initiator can be selected from one or more material of the following: ammonium persulphate, potassium persulfate and other metal persulphate; 2,2'-azobis(2-methyl-N-(2-hydroxyethyl)propionamide), 2,2'-azobis(2-methyl-N-(1,1-bis(hydroxymethyl) 2-hydroxyethyl)propionamide) and other azo series initiator. The amount of the water-soluble initiator accounts for 1-50 wt % of the cationic monomer, preferably 5-30 wt %. The temperature of the second polymerization reaction is 60-90° C. In addition, the polymerization time of the shell layer is 2-20 hours, preferably 2-10 hours.

5. Process of Filtrating/Cleaning:

When taking an inorganic compound colloid as a dispersion stabilizer, adjusting the pH value of the toner particles suspension liquid obtained from the second polymerization at 6.5 or less to dissolve the inorganic compound colloid which is difficult to be dissolved in water by adding an acid. As the acid to be added, sulfuric acid (preferable), hydrochloric acid, nitric acid and other inorganic acids and formic acid, acetic acid and other organic acids can be used. Sulfuric acid has high removal efficiency for the inorganic compound colloid, with small burden on equipments.

The process further includes the following steps: cleaning and filtrating with a large amount of deionized water can be repeated to remove a large number of electrolytes in water. The Filtering method includes centrifugation filtration, vacuum filtration, pressure filtration, and other filtration.

6. Process of Drying:

The process is used to dry the toner particles which have been carried out a cleaning treatment. The dryers used in drying treatment for the toner include spray dryer, vacuum freeze dryer, vacuum dryer, fluidized bed dryer and etc. In order to avoid agglomeration phenomena occur during drying, it is preferable to use mobile plate dryers, fluidized bed dryers, rotary dryers, ribbon stirring fluidized dryer and other drying equipment. In order to prevent toner particles sticking, the drying temperature is preferably 40-50° C.

7. Process of External Additive

The process is used to add an external additive to the toner particles having been carried out the drying process.

The chargeability, fluidity and storage stability of the toner particles can be adjusted by attaching or burying an external additive into the surface of the toner particles. The external additive for the toner can be selected from one or more material of the following: silicon dioxide, aluminium oxide, titanium dioxide and other inorganic particles and magnesium silicate, magnesium laurate, calcium stearate, magnesium stearate and other metal salt of fatty acid particles. The silica dioxide after hydrophobic modification is preferable. Generally the particles of gas phased silicon dioxide having a small particle diameter of 6-20 nm can effectively improve the fluidity of the toner particles. The compound use of the particles of spherical silicon dioxide having a medium particle diameter of 40-80 nm and the particles of silicon dioxide having a small particle diameter can improve the electrified amount of the toner particles, while avoiding the additive being buried into the surface of the toner particles due to its isolation effect. The metal salt of fatty acid particles help to adjust the electrification amount of the toner, and improve the printing durability of the toner particles. The amount of the additive generally accounts for 0.1-5 wt % of the toner.

As a means for adding external additives, Henschel mixer, a homomixer, a jet milling mixer and other well-known mixing apparatuses can be used. Mechanical pulverizing apparatuses can effectively reduce aggregation phenomena after drying treatment caused by gravity of weak interparticles to achieve uniform mixing and appropriate adhesion of external additives and toner particles.

The suspension polymerization toner of core-shell structure with dense charge uniformly distributing can be obtainedby the above preparation process. It has a storability and low-temperature fixability of toners.

The present patent application will be described further in detail in conjunction with specific embodiments as follows.

In the following embodiments, "parts" and "%" means weight parts and "% by weight", unless otherwise noted. Evaluation results of examples and compared examples are summarized in Table 1.

EXAMPLE 1

86 parts of styrene, 14 parts of n-butylacrylate, 0.6 parts of divinylbenzene, 1.0 part of 1-dodecanethiol, 2 parts of positively chargeable charge control agent (FCA-201-PS, styrene-acrylic acid copolymer, from Japan Teng warehouse Kasei Corporation), 7 parts of carbon black NP150 (manufactured by Degussa), 8 parts of ester wax WE-95 (Nippon Oil & Fats Corporation) and 10 parts of styrene-methacrylic acid-methyl methacrylate-α-methylstyrene copolymer (Mw of 10000, Tg of 96° C.) are uniformly dissolved and mixed to prepare the monomer oil phase.

Additionally, aqueous solution of magnesium chloride formed by dissolving 13 parts of magnesium chloride with 100 parts of deionized water is slowly added into another aqueous solution of sodium hydroxide formed by dissolving 8.3 parts of sodium hydroxide with 200 parts of deionized water; shearing and dispersing at a high speed for 1 hour, and ultrasonic aging for 4 hours at room temperature. The suspension dispersion liquid of magnesium hydroxide can be obtained.

The process includes the following steps: dispersing 2 parts of methyl methacrylate and 0.2 parts of dimethyl diallyl ammonium chloride in 20 parts of deionized water; carrying out ultrasonic shearing to achieve uniform dispersion; dissolving 1 part of the ammonium persulphate initiator in 10 parts of deionized water to prepare the initiator solution.

The process further includes the following steps: slowly adding the monomer oil phase into the suspension dispersion liquid of magnesium hydroxide; carrying out shearing with a high-speed disperser (Ultratalax T50, manufactured by IKA) at the speed of 6000 rpm for 10 minutes; then transferring the result mixture to a nitrogen protective reactor; heating to 85° C. to carry out a polymerization reaction for 10 hours; adding the prepared dispersion liquid of the cationic monomer component into the reaction system; setting the speed to 400 rpm; adding the initiator solution to initiate the reaction after dispersing for 15 minutes; stopping the reaction after 5 hours; removing magnesium hydroxide from the polymerization product; repeatedly cleaning with a large number of deionized water until the pH value of the product being about 7; filtrating, drying the product; adding external addition of 1% silicon dioxide (R504, manufactured by Degussa) to process. The suspension polymerization toner of the present patent application can be obtained. Evaluation results of the resulting toner characteristic are shown in Table 1 below.

EXAMPLE 2

86 parts of styrene, 14 parts of n-butylacrylate, 0.5 parts of divinylbenzene, 0.8 parts of 1-dodecanethiol, 2 parts of positively chargeable charge control agent (FCA-201-PS, styrene-acrylic acid copolymer, manufactured by Japan Teng warehouse Kasei Corporation), 5 parts of phthalocyanine pigment (C.I. Pigment Blue 15: 3, manufactured by Clariant Corporation), 8 parts of pentaerythrityl tetrastearate (manufactured by Shandong Liaocheng Chemical Corporation) and 30 parts of styrene-methacrylic acid-methyl methacrylate copolymer (Mw of 150000, Tg of 100° C.) are dissolved and mixed uniformly by grinding media at the room temperature to prepare the monomer oil phase.

The performing procedure of this example is substantially the same with that of Example 1. Evaluation results of characteristic of the resulting toner are shown in Table 1 below.

EXAMPLE 3

The performing procedure of this example is substantially the same with that of Example 1, except changing 0.2 parts of dimethyl diallyl ammonium chloride to 0.3 parts of acryloyloxyethyl trimethyl ammonium chloride. Evaluation results of characteristic of the resulting toner are shown in Table 1 below.

COMPARED EXAMPLE 1

The performing procedure of this example is substantially the same with that of Example 1, except without adding styrene-methacrylic acid-methyl methacrylate-α-methylstyrene copolymer (Mw of 10000, Tg of 96° C.). Evaluation results of characteristic of the resulting toner are shown in Table 1 below.

COMPARED EXAMPLE 2

The performing procedure of this example is substantially the same with that of Example 1, except changing 10 parts of styrene-methacrylic acid-methyl methacrylate- α-methylstyrene copolymer (Mw of 10000, Tg of 96° C.) to 50 parts. Evaluation results of characteristic of the resulting toner are shown in Table 1 below.

COMPARED EXAMPLE 3

The performing procedure of this example is substantially the same with that of Example 1, except changing 0.2 parts of dimethyl diallyl ammonium chloride to 1 part. Evaluation results of characteristic of the resulting toner are shown in Table 1 below.

The toner particles obtained from the Example and Compared Example are measured as following:

(1) Measurement of Particle Diameter

Specific measurement method is as follows: weighting and measuring about 0.1 g toner particles; placing it in a beaker; adding 0.01 g sodium dodecylbenzenesulfonate and 30 ml deionized water, dispersing it in a dispersion of 60 W ultrasonic for 3 minutes; measuring the number of particles using a coulter particle counter (Multisizer3, manufactured by Beckman Corporation) with the pore size at 100 μm and the number of particles reaches 50,000, and measuring volume average particle diameter (Dv) and mean particle diameter (Dn) to calculate particle size distribution (Dv)/(Dn).

(2) Measurement of Apparent Density

Powder tester (manufactured by Hosokawa Micron Corporation) can be used to measure as follows: screening, flatting and loosely filling the toner particles from the top of the self-measurement container to 22 cm; correctly reading the volume of the filled toner; and accurately measuring the weight of the filled toner, calculating the apparent density with the following formula:

Apparent density=the weight of the filled toner/the volume of the filled toner (3) Measurement of Storability The measurement method can be as follows: placing toner in a closable container; taking it out after disposing at temperature of 50° C. for two weeks; transferring it to a shaker having 42 meshes, and the amplitude being set to 1.0 mm; measuring the weight of the toner remained on the shaker after shaking for 30 seconds.; calculating the ratio of the weight of the agglomeration toner with the weight of toner primarily added into the container. A sample can be measured three times. The average value thereof can be viewed as an indication of the storability.

(4) Measurement of Electrified Amount

The measurement method can be as follows: adding the toner into a developing device of a printer which runs in 600 dpi high-speed non-magnetic single-component development way; disposing it at the environment of temperature of 23° C. and humidity (N/N) of 50% and at the environment of temperature of 35° C. and humidity of 80% (H/H) for 24 hours respectively; and measuring the electrified amount of the toner with Q/M electrification amount tester.

(5) Measurement of Environmental Stability

Q/M electrified amount tester can be used to measure as follows: adding the toner into the cartridge of Brother HL-3040CN color printer; disposing it at the environment of temperature of 35° C. and humidity (H/H) of 80% for 24 hours; and measuring the electrified amount of the toner with Q/M electrified amount tester.

(6) Fixation Temperature

Fixing experiments can be carried out using a transformed single component developing printer which can change the temperature of a fixing roller. The fixing test can be carried out as follows: changing the temperature of the fixing roller of the printer per 5° C.; and measuring the fixing rate of the toner at each temperature. The fixing rate is calculated by the ratio of the image density of printing all black area before and after using the operation of tap stripping. The minimum temperature of the fixing roller at which the fixing rate is greater or equal to 80% can be viewed as the fixation temperature of the toner. If the fixation temperature is low, the toner is suitable for high-speed printing.

TABLE 1

| | Example 1 | Example 2 | Example 3 | Compared Example 1 | Compared Example 2 | Compared Example 3 |
|---|---|---|---|---|---|---|
| Volume average particle diameter (μm) | 7.0 | 7.2 | 7.3 | 7.1 | 6.8 | 7.2 |
| Particle diameter distribution ($D_V/D_P$) | 1.22 | 1.21 | 1.23 | 1.31 | 1.23 | 1.18 |
| Apparent Density (g/cm$^3$) | 0.35 | 0.39 | 0.36 | 0.45 | 0.37 | 0.30 |
| Storability (%) | 2.0 | 1.5 | 2.5 | 11.1 | 2.2 | 2.1 |

TABLE 1-continued

| | Example 1 | Example 2 | Example 3 | Compared Example 1 | Compared Example 2 | Compared Example 3 |
|---|---|---|---|---|---|---|
| N/N (+μC/g) | 26.2 | 25.0 | 28.7 | 24.5 | 25.9 | 32.2 |
| H/H(+μC/g) | 24.6 | 24.2 | 24.3 | 22.8 | 24.1 | 15.7 |
| Fixation temperature (° C.) | 128 | 130 | 128 | 129 | 160 | 130 |

From evaluation results of the toner for developing electrostatic charge in Table 1, it can be found that:

The toner particles of Compared Example 1 have a poor stability, due to relatively soft toner particles, and the phenomenon of agglomeration and caking easily occur. The toner particles of Compared Example 2 have a good electrified amount, but the amount of the polar resin is excessive, which results in an increase of temperature of fixation and a reduced low-temperature fixation. The toner particles of Compared Example 3 have a substantial improved electrified amount, but there are also some problems about environmental stability. For surface of the particles having a number of ionic bonds, it allows the toner particles to absorb moisture. The electrified amount and environmental durability of the toner have deteriorated.

In contrast, the toner particles of Example 1, 2, 3 have a uniform and stable charging performance, at the same time, a good low-temperature fixation property and environmental stability.

Various exemplary embodiments are described herein. Reference is made to these examples in a non-limiting sense. They are provided to illustrate more broadly applicable aspects of the disclosed technology. Various changes can be made and equivalents can be substituted without departing from the true spirit and scope of the various embodiments. In addition, many modifications can be made to adapt a particular situation, material, composition of matter, process, process act(s) or step(s) to the objective(s), spirit or scope of the various embodiments. Further, as will be appreciated by those with skill in the art, each of the individual variations described and illustrated herein has discrete components and features which can be readily separated from or combined with the features of any of the other several embodiments without departing from the scope or spirit of the various embodiments.

What is claimed is:

1. A method for preparing suspension polymerization toner of core-shell structure, comprising:

(1) preparing a monomer oil phase which contains a certain amount of polar resin forming toner soft core resin and aqueous dispersion liquid to disperse the monomer oil phase respectively, the monomer oil phase is formed by uniformly mixing a monovinyl monomer forming soft core resin core layer, a release agent, a charge control agent, a colorant, a crosslinker, a chain transfer agent, an initiator and a certain amount of polar resin, and the difference between the Glass transition temperature (Tg) of the resin forming the core layer and the Tg of the resin forming the shell layer should be greater than 20° C.; the weight-average molecular weight of the polar resin ranges in 6000-250000; the amount of the polar resin accounts for 5-30 wt % of the monovinyl monomer; the amount of the release agent accounts for 1-30 wt % of the monovinyl monomer; the amount of the charge control agent accounts for 0.1-5 wt % of the monovinyl monomer; the amount of the pigment is 1-30 wt % of the monovinyl monomer; the amount of the crosslinker accounts for 0.1-10 wt % of the monovinyl monomer; the amount of the chain transfer agent accounts for 0.01-10 wt % of the monovinyl monomer; the amount of the initiator accounts for 0.5-20 wt % of the monovinyl monomer;

(2) adding the monomer oil phase into the aqueous dispersion liquid, transferring a mixture into a reactor after high-speed shearing and suspension granulation, keeping the stirring speed at 100-1000 rpm to suspend and disperse the dispersion droplet, the temperature of polymerization is 60-95° C., the time of polymerization is 2-20 hours, and obtaining toner particles of soft-core hard-shell structure;

(3) taking the toner particles of soft-core hard-shell structure as a core layer, adding a cationic monomer component, and carrying out a second polymerization reaction through a water-soluble initiator to obtain the toner particles of soft-core hard-shell structure with dense charge surface layers uniformly distributed on outer surfaces, the cationic monomer component contains the comonomer of the polymer with the formation of Tg greater than 70° C. added with the cationic monomer simultaneously; and (4) cleaning, filtering, and sufficiently drying a product of the second polymerization reaction, and then adding silicon dioxide to obtain the suspension polymerization toner of core-shell structure having an average particle diameter of 5-10 μm.

2. The method for preparing the suspension polymerization toner of core-shell structure of claim 1, wherein the monovinyl monomer comprises one or more monomer of aromatic vinyl of following: styrene, methyl styrene or vinyl toluene; or one or two monoolefine monomer of following: ethylene or propylene; or one or more material of acrylic acid and serial derivatives hereof of following: methyl acrylate, ethyl acrylate, butyl acrylate, cyclohexyl acrylate, methyl methacrylate, ethyl methacrylate, hydroxyethyl methacrylate or glycidyl methacrylate.

3. The method for preparing the suspension polymerization toner of core-shell structure of claim 1, wherein the crosslinker comprises a monomer containing two or more unsaturated vinyl groups, which is selected from one or more material of following: divinylbenzene, 2-methyl-1,3-butadiene, 1,3-butadiene, divinyl ether, divinyl sulfone, ethylene glycol dimethacrylate, triethylene glycol diacrylate, triethylene glycol dimethacrylate, 1,4-butanedioldimethacrylate, 1,6-hexanediol dimethacrylate, trimethylolpropane triacrylate, trimethylolpropane trimethacrylate or pentaerythritol triacrylate.

4. The method for preparing the suspension polymerization toner of core-shell structure of claim 1, wherein the chain transfer agent is selected from one or more material of following: 1-dodecanethiol, t-dodecyl mercaptan, carbon tetrachloride, carbon tetrabromide; the amount of the chain transfer agent accounts for 0.01-10 wt % of the monovinyl monomer.

5. The method for preparing the suspension polymerization toner of core-shell structure of claim 1, wherein the charge control agent is selected from one or more material of following: CCA1,CCA2,CCA3,CCA501,TP-415,TP-302,FCA-201-PS or FCA-207-P.

6. The method for preparing the suspension polymerization toner of core-shell structure of claim 1, wherein the release agent is selected from one or more compounds selected from low molecular weight polyethylene waxes, polypropylene waxes and grease synthetic waxes having a hydroxyl value of less than 10 mgKOH/g, an acid value of less than 2 mgKOH/g; waxes have a melting point of 50-100° C.

7. The method for preparing the suspension polymerization toner of core-shell structure of claim 1, wherein the initiator is an oil-soluble initiator, which is selected from one or more material of azo initiators or peroxide initiators of following:

2,2'-azobisisoheptonitrile, 2,2'-azoisobutyronitrile, 2,2'-azobis-(2-methylbutyronitrile), dimethyl 2,2'-azobis(2-methylpropionate), benzoyl peroxide, dilauroyl peroxide, tert-Butyl peroxy-2-ethylhexanoate, tert-Butyl peroxy diethyl acetate or tert-butylperoxyisobutyrate.

8. The method for preparing the suspension polymerization toner of core-shell structure of claim 1, wherein the polar resin refers to a resin long chain containing ester bond, amido bond, ether bond, urethane bond or imine bond structure formed by polycondensation or addition polymerization reaction, a weight-average molecular weight of the polar resin ranges in 6000-250000, Tg of the polar resin ranges in 80-120° C.

9. The method for preparing the suspension polymerization toner of core-shell structure of claim 1, wherein in step (1), the aqueous dispersion liquid contains at least one dispersion stabilizer including: an inorganic salt, an inorganic oxide, an inorganic compound, a water-soluble polymer or a surfactant.

10. The method for preparing the suspension polymerization toner of core-shell structure of claim 8, wherein the cationic monomer comprises a cationic monomer containing at least one unsaturated double bond, is selected from one or more material of following: dimethyl diallyl ammonium chloride, acryloyloxyethyl trimethyl ammonium chloride, diethylaminoethyl acrylate or N,N-dimethyl-4-vinylaniline, the amount of the cationic monomer accounts for 0.1-2 wt % of the monovinyl monomer.

11. The method for preparing the suspension polymerization toner of core-shell structure of claim 8, wherein the high-Tg monomer is one or more mixture of monomers of polymers having a glass-transition temperature greater than 80° C., the amount of the high-Tg accounts for 0.1-10 wt %of the monovinyl monomer.

12. The method for preparing the suspension polymerization toner of core-shell structure with dense charges of claim 8, wherein in step (3), the water-soluble initiator is selected from one or more material of following: potassium persulfate, ammonium persulphate, 2,2'-azobis (2-methyl-N-(2-hydroxyethyl) propionamide) or 2,2'-azobis (2-methyl -N-(1,1- bis (hydroxymethyl)-2-hydroxyethyl) propionamide), the amount of the water-soluble initiator accounts for 5-30 wt % of the cationic monomer component.

* * * * *